US008810139B2

(12) United States Patent
Kim et al.

(10) Patent No.: US 8,810,139 B2
(45) Date of Patent: Aug. 19, 2014

(54) DISPLAY DEVICE AND EMITTING DRIVER FOR THE SAME

(71) Applicants: Yun-Ho Kim, Yongin (KR); Young-Wook Yoo, Yongin (KR)

(72) Inventors: Yun-Ho Kim, Yongin (KR); Young-Wook Yoo, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 0 days.

(21) Appl. No.: 13/894,468

(22) Filed: May 15, 2013

(65) Prior Publication Data

US 2014/0132162 A1 May 15, 2014

(30) Foreign Application Priority Data

Nov. 14, 2012 (KR) ..... 10-2012-0128888

(51) Int. Cl.
*G09G 3/10* (2006.01)
*H05B 37/02* (2006.01)
*G09G 3/30* (2006.01)

(52) U.S. Cl.
USPC ..... 315/169.3; 315/290 R; 345/76; 345/211

(58) Field of Classification Search
USPC ..... 315/169.1–169.3, 209 R, 210, 291, 307, 315/308; 345/76–83, 90–92, 100, 204, 211
See application file for complete search history.

(56) References Cited

U.S. PATENT DOCUMENTS

2012/0188290 A1* 7/2012 Park et al. ..... 345/690

FOREIGN PATENT DOCUMENTS

| | | | |
|---|---|---|---|
| KR | 10-2008-0033630 | A | 4/2008 |
| KR | 10-0911982 | B1 | 8/2009 |
| KR | 10-2010-0009219 | A | 1/2010 |
| KR | 10-2011-0124075 | A | 11/2011 |

* cited by examiner

*Primary Examiner* — Jimmy Vu
(74) *Attorney, Agent, or Firm* — Lee & Morse, P.C.

(57) ABSTRACT

A light emitting driving apparatus includes light emitting driving blocks respectively having a first node applied with a second light emitting power source voltage, a second node applied with the first light emitting power source voltage, the second node being coupled to a relay signal output terminal outputting a relay signal, a third node applied with the first light emitting power source voltage, and applied with a third light emitting power source voltage, the third node being coupled to a reverse light emitting signal output terminal outputting a reverse light emitting signal, a first transistor turned on by a voltage of the first node to transmit the second light emitting power source voltage to a light emitting signal output terminal, and a second transistor turned on by a voltage of the second node to transmit the first light emitting power source voltage to the light emitting signal output terminal.

21 Claims, 6 Drawing Sheets

DISPLAY DEVICE AND EMITTING DRIVER FOR THE SAME

CROSS-REFERENCE TO RELATED APPLICATION

This application claims priority to and the benefit of Korean Patent Application No. 10-2012-0128888 filed in the Korean Intellectual Property Office on Nov. 14, 2012, the entire contents of which are incorporated herein by reference.

BACKGROUND

1. Field

Embodiments relate to a display device and a light emitting driving apparatus for a display device.

2. Description of the Related Art

An organic light emitting diode (OLED) display uses an organic light emitting diode (OLED) having luminance that is controlled by a current or a voltage. The organic light emitting diode (OLED) includes an anode and a cathode forming an electric field, and an organic light emitting material emitting light by the electric field.

In general, the organic light emitting diode (OLED) display is classified into a passive matrix type of OLED (PMOLED) and an active matrix type of OLED (AMOLED) according to a driving method of the organic light emitting diode (OLED).

Among them, in views of resolution, contrast, and operation speed, the AMOLED that is selectively turned on for every unit pixel is mainly used.

The AMOLED flows the current to the organic light emitting diode (OLED) of a light emitting element to generate the light thereby displaying an image. At this time, a driving transistor of each pixel flows a predetermined current according to a grayscale of image data.

The above information disclosed in this Background section is only for enhancement of understanding of the background of the invention and therefore it may contain information that does not form the prior art that is already known in this country to a person of ordinary skill in the art.

SUMMARY

Embodiments are directed to a light emitting driving apparatus for a display device, the apparatus including a plurality of light emitting driving blocks. The plurality of light emitting driving blocks may respectively include a first node applied with a second light emitting power source voltage according to a clock signal input to a first clock signal input terminal and applied with a first light emitting power source voltage according to a clock signal input to a second clock signal input terminal, a second node applied with the first light emitting power source voltage according to the clock signal input to the first clock signal input terminal, the second node being coupled to a relay signal output terminal outputting a relay signal, a third node applied with the first light emitting power source voltage according to the clock signal input to the first clock signal input terminal, and applied with a third light emitting power source voltage according to a clock signal input to the second clock signal input terminal, the third node being coupled to a reverse light emitting signal output terminal outputting a reverse light emitting signal, a first transistor turned on by a voltage of the first node to transmit the second light emitting power source voltage to a light emitting signal output terminal outputting a light emitting signal, and a second transistor turned on by a voltage of the second node to transmit the first light emitting power source voltage to the light emitting signal output terminal.

The plurality of light emitting driving blocks may further respectively include a third transistor having a gate electrode coupled to the first node, a first electrode coupled to the first light emitting power source voltage, and a second electrode coupled to the second node.

The plurality of light emitting driving blocks may further respectively include a fourth transistor having a gate electrode coupled to the third node, a first electrode coupled to the second light emitting power source voltage, and a second electrode coupled to the second node.

The plurality of light emitting driving blocks may further respectively include a fifth transistor having a gate electrode coupled to the first clock signal input terminal, a first electrode coupled to the second light emitting power source voltage, and a second electrode coupled to the first node.

The plurality of light emitting driving blocks may respectively include: a sixth transistor having a gate electrode coupled to the third node and a first electrode coupled to the first light emitting power source voltage, and a seventh transistor having a gate electrode coupled to the third node, a first electrode coupled to a second electrode of the sixth transistor, and a second electrode coupled to the first node.

The plurality of light emitting driving blocks may further respectively include a fourth node applied with a relay signal input to a sequential input terminal according to the clock signal input to the first clock signal input terminal, and a ninth transistor having a gate electrode coupled to the fourth node, a first electrode applied with a third light emitting power source voltage according to the clock signal input to the second clock signal input terminal, and a second electrode coupled to the third node.

The plurality of light emitting driving blocks may further respectively include a fourteenth transistor having a gate electrode coupled to the second clock signal input terminal, a first electrode coupled to the third light emitting power source voltage, and a second electrode coupled to a first electrode of the ninth transistor.

The plurality of light emitting driving blocks may further respectively include a tenth transistor having a gate electrode coupled to the first clock signal input terminal, a first electrode coupled to the first light emitting power source voltage, and a second electrode coupled to the third node.

The plurality of light emitting driving blocks may further respectively include an eleventh transistor having a gate electrode coupled to the first clock signal input terminal, a first electrode coupled to the sequential input terminal, and a second electrode coupled to the fourth node.

The plurality of light emitting driving blocks may respectively include an entire reset signal input terminal, and a plurality of light emitting driving blocks may simultaneously output the first light emitting power source voltage to the light emitting signal output terminal and simultaneously output the second light emitting power source voltage to the relay signal output terminal, and may simultaneously output the third light emitting power source voltage to the reverse light emitting signal output terminal according to an entire reset signal input to the entire reset signal input terminal.

The plurality of light emitting driving blocks may further respectively include an eighth transistor having a gate electrode coupled to the entire reset signal input terminal, a first electrode coupled to the second light emitting power source voltage, and a second electrode coupled to the third node.

The plurality of light emitting driving blocks may further respectively include a twelfth transistor having a gate electrode coupled to the entire reset signal input terminal, a first electrode coupled to the first light emitting power source voltage, and a second electrode coupled to the fourth node.

The plurality of light emitting driving blocks may further respectively include a thirteenth transistor having a gate electrode coupled to the entire reset signal input terminal, a first electrode coupled to the first light emitting power source voltage, and a second electrode coupled to the light emitting signal output terminal.

At least one of the first to fourteenth transistors may be an oxide thin film transistor.

Embodiments are also directed to a display device, including a plurality of pixels including a driving transistor controlling a driving current flowing to an organic light emitting diode (OLED) and a sustain capacitor including a first electrode coupled to a gate electrode of the driving transistor, and a light emission driver outputting a reverse light emitting signal of a gate-on voltage to apply a reference voltage to a second electrode of the sustain capacitor during a period in which a data voltage is respectively applied to a plurality of pixels, and outputting a light emitting signal of the gate-on voltage to apply a first power source voltage to the second electrode of the sustain capacitor during a period in which the OLED emits light by the driving current, wherein the light emission driver includes a plurality of light emitting driving blocks. The plurality of light emitting driving blocks may respectively include a first node applied with a second light emitting power source voltage according to a clock signal input to a first clock signal input terminal, and applied with a first light emitting power source voltage according to a clock signal input to a second clock signal input terminal, a second node applied with the first light emitting power source voltage according to the clock signal input to the first clock signal input terminal, the second node being coupled to a relay signal output terminal outputting a relay signal, a third node applied with the first light emitting power source voltage according to the clock signal input to the first clock signal input terminal, and applied with a third light emitting power source voltage according to a clock signal input to the second clock signal input terminal, the third node being coupled to a reverse light emitting signal output terminal outputting a reverse light emitting signal, a first transistor turned on by a voltage of the first node to transmit the second light emitting power source voltage to a light emitting signal output terminal outputting the light emitting signal, and a second transistor turned on by a voltage of the second node to transmit the first light emitting power source voltage to the light emitting signal output terminal.

The driving transistor may include the gate electrode coupled to first electrode of the sustain capacitor, a first electrode applied with the first power source voltage according to the light emitting signal, and a second electrode coupled to the OLED according to the light emitting signal.

The plurality of pixels may further respectively include a switching transistor turned on by a scan signal of a gate-on voltage to transmit the data voltage to the first electrode of the driving transistor, and a compensation transistor turned on by the scan signal of the gate-on voltage to diode-connect the driving transistor.

The plurality of pixels may further respectively include an initialization transistor that is turned on by an earlier scan signal, which is applied before the scan signal of the gate-on voltage is applied, to transmit an initialization voltage to the gate electrode of the driving transistor.

The plurality of pixels may further respectively include a first light emitting transistor having a gate electrode applied with the light emitting signal, a first electrode coupled to the first power source voltage, and a second electrode coupled to the first electrode of the driving transistor, and a second light emitting transistor having a gate electrode applied with the light emitting signal, a first electrode coupled to the second electrode of the driving transistor, and a second electrode coupled to the OLED.

The plurality of pixels may further respectively include a first reference voltage transistor having a gate electrode applied with the reverse light emitting signal, a first electrode coupled to the reference voltage, and a second electrode coupled to the second electrode of the sustain capacitor, and a second reference voltage transistor having a gate electrode applied with the light emitting signal, a first electrode coupled to the first power source voltage, and a second electrode coupled to the second electrode of the sustain capacitor.

At least one of the switching transistor, the driving transistor, the compensation transistor, the initialization transistor, the first light emitting transistor, the second light emitting transistor, the first reference voltage transistor, and the second reference voltage transistor may be an oxide thin film transistor.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
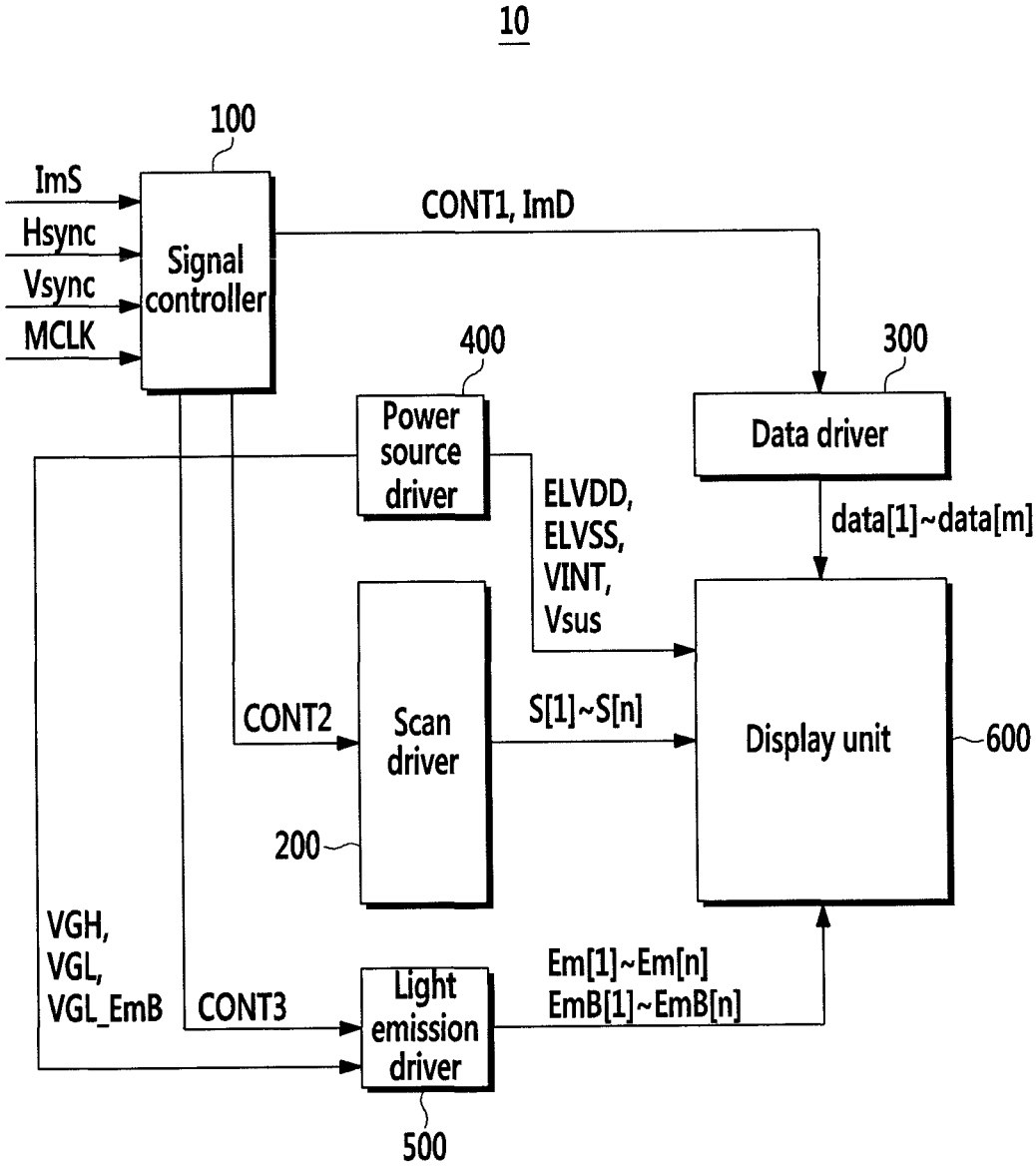
FIG. 1 is a block diagram of a display device according to an example embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

Further, in the embodiments, like reference numerals designate like elements throughout the specification representatively in a first embodiment, and only elements of other embodiments other than those of the first embodiment will be described.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram of a display device according to an example embodiment.

In the example embodiment shown in FIG. 1, a display device 10 includes a signal controller 100, a scan driver 200, a data driver 300, a power source driver 400, a light emission driver 500, and a display unit 600.

The signal controller 100 receives a video signal Ims and a synchronization signal input from an external device. The input video signal ImS includes luminance information on a plurality of pixels. The luminance has a predetermined number of grays, for example, 1024 ($=2^{10}$), 256 ($=2^{8}$), or 64 ($=2^{6}$). The synchronization signal includes a horizontal synchronization signal Hsync, a vertical synchronization signal Vsync, and a main clock signal MCLK.

The signal controller 100 generates first to third driving control signals CONT1, CONT2, and CONT3 and an image data signal ImD according to the video signal ImS, the horizontal synchronization signal Hsync, the vertical synchronization signal Vsync, and the main clock signal MCLK.

The signal controller 100 generates the image data signal ImD by dividing the video signal ImS into a frame unit according to the vertical synchronization signal Vsync and dividing the image data signal ImS into a scan line unit according to the horizontal synchronization signal Hsync. The signal controller 100 transmits the image data signal ImD along with the first driving control signal CONT1 to the data driver 300.

The display unit 600 includes a display area including a plurality of pixels. A plurality of scan lines substantially extended in a row direction and substantially parallel with each other, a plurality of data lines substantially extended in a column direction and substantially parallel with each other, a plurality of light emitting lines substantially extended in the row direction and substantially parallel with each other, and a plurality of reverse light emitting lines substantially extended in the row direction and substantially parallel with each other are formed in the display unit 600 to be coupled to a plurality of pixels.

The scan driver 200 is coupled to a plurality of scan lines and generates a plurality of scan signals S[1]-S[n] according to the second driving control signal CONT2. The scan driver 200 may sequentially apply the scan signals S[1]-S[n] of the gate-on voltage to a plurality of scan lines.

The data driver 300 is coupled to a plurality of data lines, and samples and holds the image data signal ImD input according to the first driving control signal CONT1 and transmits a plurality of data signals data[1]-data[m] to a plurality of data lines. The data driver 300 applies the data signals data[1]-data[m] having a predetermined voltage range to a plurality of data lines by corresponding to the scan signals S[1]-S[n] of the gate-on voltage to write data to a plurality of pixels.

The power source driver 400 provides a first power source voltage ELVDD, a second power source voltage ELVSS, an initialization voltage VINT, and a reference voltage Vsus to a plurality of pixels included in the display unit 600.

The first power source voltage ELVDD may be a high level voltage, and the second power source voltage ELVSS may be a low level voltage. The initialization voltage VINT is a voltage of a predetermined level initializing a plurality of pixels. The reference voltage Vsus is a voltage of a predetermined level to maintain the data voltage input to a plurality of pixels. The reference voltage Vsus may be a voltage of the same level as the first power source voltage ELVDD, and the reference voltage Vsus is provided to a plurality of pixels through a power source wire of the first power source voltage ELVDD and a separate wire.

Also, the power source driver 400 provides the first light emitting power source voltage VGH, the second light emitting power source voltage VGL, and the third light emitting power source voltage VGL_EmB to the light emission driver 500.

The first light emitting power source voltage VGH may be a high level voltage, and the second light emitting power source voltage VGL and the third light emitting power source voltage VGL_EmB may be low level voltages. The first light emitting power source voltage VGH and the second light emitting power source voltage VGL are driving voltages to generate the light emitting signals Em[1]-Em[n]. The third light emitting power source voltage VGL_EmB is a driving voltage to generate the reverse light emitting signals EmB[1]-EmB[n] of the low level.

The light emission driver 500 is coupled to a plurality of light emitting lines and a plurality of reverse light emitting lines, and generates a plurality of light emitting signals Em[1]-Em[n] and a plurality of reverse light emitting signals EmB[1]-EmB[n] according to the third driving control signal CONT3. When writing the data to a plurality of pixels, the light emission driver 500 sequentially applies the light emitting signals Em[1]-Em[n] of the gate-off voltage to a plurality of light emitting lines, and sequentially applies the light emitting signals Em[1]-Em[n] of the gate-on voltage after writing the data thereby light emitting a plurality of pixels. The light emission driver 500 applies a plurality of reverse light emitting signals EmB[1]-EmB[n] with the level that is reverse to the light emitting signals Em[1]-Em[n] to a plurality of reverse light emitting lines.

Figure 2:
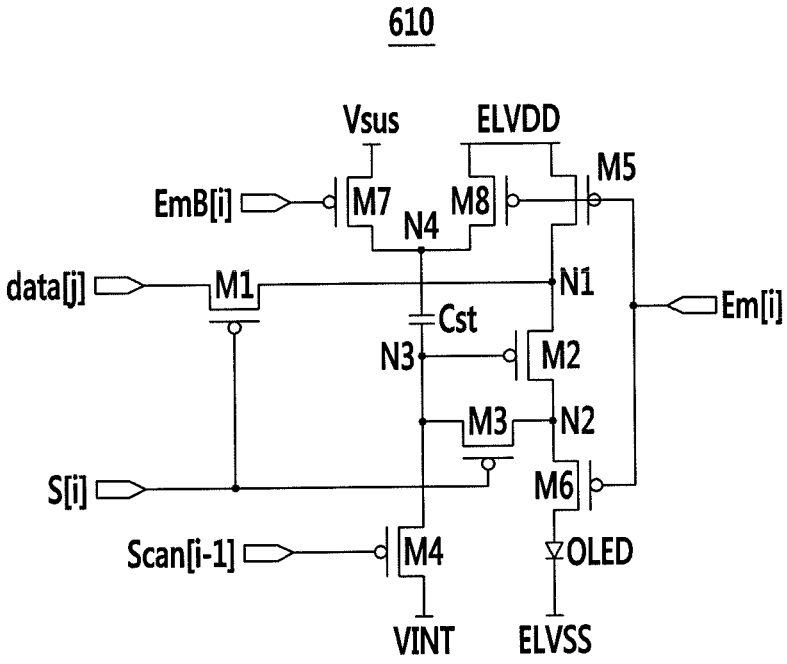
FIG. 2 is a circuit diagram of a pixel according to an example embodiment.

FIG. 2 is a circuit diagram of a pixel according to an example embodiment. FIG. 2 represents one pixel among a plurality of pixels included in the display device 10 of FIG. 1.

In the example embodiment shown in FIG. 2, a pixel 610 includes a switching transistor M1, a driving transistor M2, a compensation transistor M3, an initialization transistor M4, a first light emitting transistor M5, a second light emitting transistor M6, a first reference voltage transistor M7, a second reference voltage transistor M8, a sustain capacitor Cst, and an organic light emitting diode (OLED).

The switching transistor M1 includes a gate electrode coupled to a scan line, one electrode coupled to a data line, and the other electrode coupled to a first node N1. The switching transistor M1 is turned on by a scan signal S[i] of the gate-on voltage applied to the scan line to transfer a data signal data[j] applied to the data line to the first node N1.

The driving transistor M2 includes the gate electrode coupled to a third node N3, one electrode coupled to a first node N1, and the other electrode coupled to a second node N2. The driving transistor M2 is turned off or on by the voltage of the third node N3 to control the driving current from the first power source voltage ELVDD to the organic light emitting diode (OLED).

The compensation transistor M3 includes the gate electrode coupled to the scan line, one electrode coupled to the second node N2, and the other electrode coupled to the third node N3. The compensation transistor M3 is turned on by the scan signal S[i] of the gate-on voltage applied to the scan line for a diode-connection of the driving transistor M2.

The initialization transistor M4 includes the gate electrode coupled to the scan line arranged previously by one row than the scan line coupled to the switching transistor M1, one electrode coupled to the initialization voltage VINT, and the other electrode coupled to the third node N3. The initialization transistor M4 is turned on by the scan signal S[i−1] of the gate-on voltage applied to the scan line that is previously arranged to transmit the initialization voltage VINT to the third node N3.

The first light emitting transistor M5 includes the gate electrode coupled to the light emitting line, one electrode coupled to the first power source voltage ELVDD, and the other electrode coupled to the first node N1. The first light emitting transistor M5 is turned on by the light emitting signals Em[i] of the gate-on voltage to transmit the first power source voltage ELVDD to the first node N1.

The second light emitting transistor M6 includes the gate electrode coupled to the light emitting line, one electrode coupled to the second node N2, and the other electrode coupled to the anode of the organic light emitting diode (OLED). The second light emitting transistor M6 is turned on by the light emitting signals Em[i] of the gate-on voltage to connect the second node N2 and the anode of the organic light emitting diode (OLED).

The first reference voltage transistor M7 includes the gate electrode coupled to the reverse light emitting line, one electrode coupled to the reference voltage Vsus, and the other electrode coupled to the fourth node N4. The first reference voltage transistor M7 is turned on by the reverse light emitting signals EmB[i] of the gate-on voltage applied to the reverse light emitting line to transmit the reference voltage Vsus to the fourth node N4.

The second reference voltage transistor M8 includes the gate electrode coupled to the light emitting line, one electrode coupled to the first power source voltage ELVDD, and the other electrode coupled to the fourth node N4. The second reference voltage transistor M8 is turned on by the light emitting signals Em[i] of the gate-on voltage applied to the light emitting line to transmit the first power source voltage ELVDD to the fourth node N4.

The sustain capacitor Cst includes one electrode coupled to the third node N3 and the other electrode coupled to the fourth node N4. The sustain capacitor Cst stores the data signal data[j] applied to the third node N3.

The organic light emitting diode (OLED) includes the anode coupled to the other electrode of the second light emitting transistor M6 and the cathode coupled to the second power source voltage ELVSS. The organic light emitting diode (OLED) may emit light of one of primary colors. Examples of primary colors may include three primary colors of red R, green G, and blue B, and a desired color may be displayed by a spatial sum or a temporal sum of the three primary colors.

In the present example embodiment, the switching transistor M1, the driving transistor M2, the compensation transistor M3, the initialization transistor M4, the first light emitting transistor M5, the second light emitting transistor M6, the first reference voltage transistor M7, and the second reference voltage transistor M8 are p-channel field effect transistors. At this time, the gate-on voltage turning on the switching transistor M1, the driving transistor M2, the compensation transistor M3, the initialization transistor M4, the first light emitting transistor M5, the second light emitting transistor M6, the first reference voltage transistor M7, and the second reference voltage transistor M8 is the low level voltage and the gate-off voltage turning them off is the high level voltage.

Here, the p-channel field effect transistor is described, but one or more of the switching transistor M1, the driving transistor M2, the compensation transistor M3, the initialization transistor M4, the first light emitting transistor M5, the second light emitting transistor M6, the first reference voltage transistor M7, and the second reference voltage transistor M8 may be n-channel field effect transistors. In this case, the gate-on voltage turning on the n-channel field effect transistor is the high level voltage and the gate-off voltage turning it off it is the low level voltage.

The switching transistor M1, the driving transistor M2, the compensation transistor M3, the initialization transistor M4, the first light emitting transistor M5, the second light emitting transistor M6, the first reference voltage transistor M7, and the second reference voltage transistor M8 may be formed with, e.g., an amorphous silicon thin film transistor (amorphous-Si TFT), a low temperature polysilicon (LTPS) thin film transistor, an oxide thin film transistor (oxide TFT), etc.

The oxide thin film transistor may include an oxide based on titanium (Ti), hafnium (Hf), zirconium (Zr), aluminum (Al), tantalum (Ta), germanium (Ge), zinc (Zn), gallium (Ga), tin (Sn), or indium (In), and as a composite oxide thereof, one of zinc oxide (ZnO), indium-gallium-zinc oxide ($InGaZnO_4$), indium-zinc oxide (Zn—In—O), zinc-tin oxide (Zn—Sn—O) indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), hafnium-indium-zinc oxide (Hf—In—Zn—O) may be used as an activation layer.

Next, a driving method of a display device 10 will be described with reference to FIGS. 1 to 3.

Figure 3:
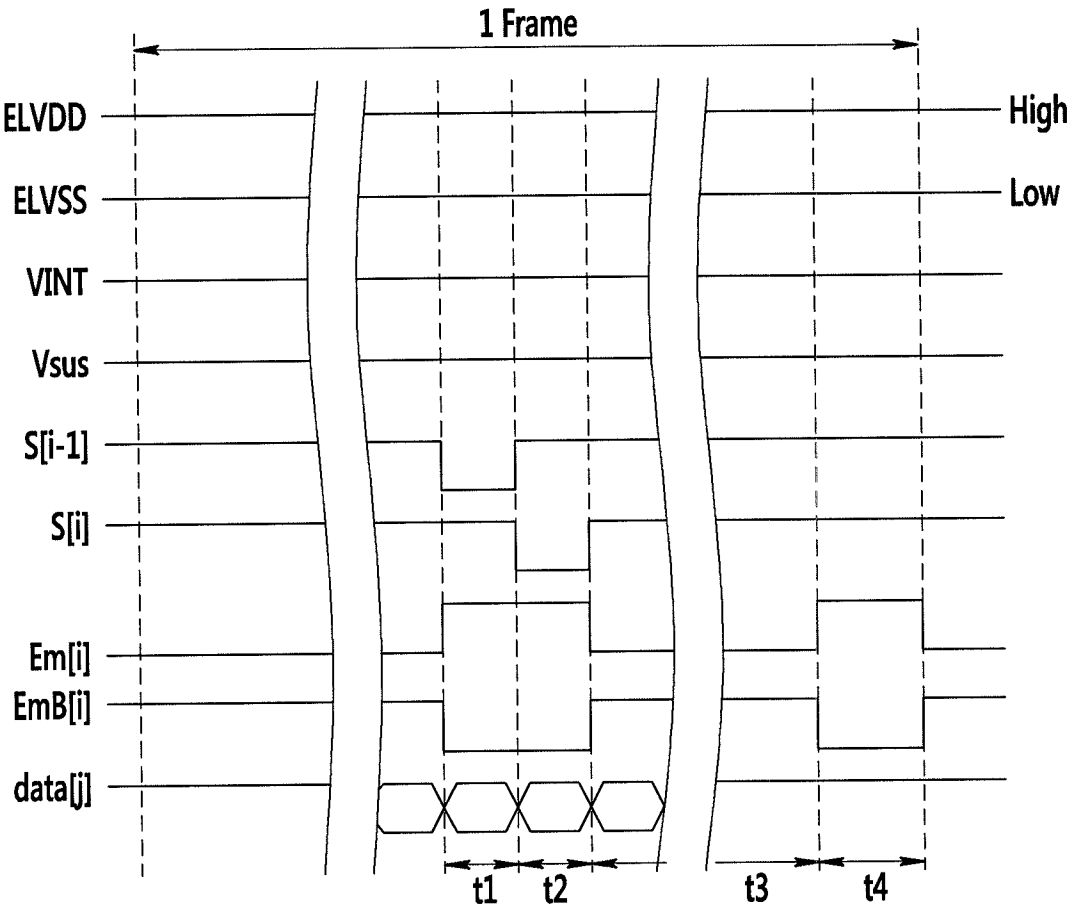
FIG. 3 is a timing diagram of a driving method of a display device according to an example embodiment.

FIG. 3 is a timing diagram of a driving method of a display device according to an example embodiment.

Referring to FIGS. 1 to 3, the first power source voltage ELVDD is applied as the high level voltage, and the second power source voltage ELVSS is applied as the low level voltage. The initialization voltage VINT and the reference voltage Vsus are applied as the voltage of a predetermined level.

The scan signals S[1]-S[n] of the gate-on voltage are sequentially applied to a plurality of scan lines. During a time t1, the scan signal S[i−1] applied to the (i−1)-th scan line is applied as the low level voltage. Also, during a time t2, the scan signal S[i] applied to the (i-th) scan line is applied as the low level voltage.

By corresponding to the scan signals S[1]-S[n] of the gate-on voltage that are sequentially applied, the light emitting signals Em[1]-Em[n] of the gate-off voltage are sequentially applied to a plurality of light emitting lines. The light emitting signal Em[i] applied to the i-th light emitting line is applied as the high level voltage during the time t1 and the time t2. The reverse light emitting signal EmB[i] applied to the i-th reverse light emitting line is applied as the low level voltage during the time t1 and the time t2.

During the time t1, the initialization transistor M4 and the first reference voltage transistor M7 are turned on. As the initialization transistor M4 is turned on, the initialization voltage VINT is transmitted to the third node N3. As the first reference voltage transistor M7 is turned-on, the reference voltage Vsus is transmitted to the fourth node N4.

Accordingly, the voltages of two terminals of the sustain capacitor Cst are initialized as the reference voltage Vsus and the initialization voltage VINT. Thus, the time t1 may be an initialization period in which the gate voltage of the driving transistor M2 is initialized as the initialization voltage VINT.

During the time t2, the switching transistor M1, the compensation transistor M3, and the first reference voltage transistor M7 are turned on. At this time, the data signal data[j] is applied as a data voltage Vdat having a predetermined voltage range. As the switching transistor M1 is turned on, the data signal data[j] is transmitted to the first node N1. As the compensation transistor M3 is turned on, the driving transistor M2 is diode-connected, and the data voltage Vdat−Vth reflecting the threshold voltage Vth of the driving transistor M2 is transmitted to the third node N3. As the first reference voltage transistor M7 is turned on, the reference voltage Vsus is applied to the fourth node N4. The sustain capacitor Cst stores the voltage Vsus−(Vdat−Vth). Thus, the time t2 may be a threshold voltage compensation and data writing period, in which the data voltage Vdat−Vth reflecting the threshold voltage Vth of the driving transistor M2 is applied to the gate electrode of the driving transistor M2.

During a time t3 after the threshold voltage compensation and data writing period, the light emitting signal Em[i] applied to the i-th light emitting line is applied as the low level voltage, and the reverse light emitting signal EmB[i] applied to the i-th reverse light emitting line is applied as the high level voltage. As the light emitting signal Em[i] is applied as the low level voltage, the first light emitting transistor M5, the second light emitting transistor M6, and the second reference voltage transistor M8 are turned on. As the first light emitting transistor M5 is turned on, the first power source voltage ELVDD is applied to the first node N1. At this time, the voltage Vdat−Vth is applied to the gate electrode of the driving transistor M2, and a driving current $Ioled=\beta/2\ (Vgs-Vth)^2=\beta/2\ \{ELVDD-(Vdat-Vth)-Vth\}^2=(ELVDD-Vdat)^2$ flows through the driving transistor M2. Here, Vgs is a voltage difference between the gate-source of the driving transistor M2, and β is a parameter determined according to a characteristic of the driving transistor M2. The driving current Ioled flowing to the organic light emitting diode (OLED) is not influenced by the threshold voltage deviation of the driving transistor M2. The second light emitting transistor M6 is turned on such that the organic light emitting diode (OLED) emits the light by the driving current Ioled. Thus, the time t3 may be a light emitting period for emitting the organic light emitting diode (OLED) according to the data voltage Vdat.

By the above-described method, a plurality of pixels perform the initialization period t1, the threshold voltage compensation and data writing period t2, and the light emitting period t3 for each scan line to be sequentially emitted.

During a time t4, a plurality of light emitting signals Em[1]-Em[n] are simultaneously applied as the high level voltage, and a plurality of reverse light emitting signals EmB[1]-EmB[n] are simultaneously applied as the low level voltage. In a state in which a plurality of all pixels emit the light through the light emitting period t3, if a plurality of light emitting signals Em[1]-Em[n] are simultaneously applied as the high level voltage, the first light emitting transistor M5 and the second light emitting transistor M6 of a plurality of pixels are respectively turned off. Accordingly, the driving current Ioled flowing to the organic light emitting diode (OLED) of a plurality of pixels is blocked, and the entire light emitting of a plurality of pixels are stopped. Thus, the time t4 may be an entire reset period in which the light emitting of a plurality of pixels is entirely stopped. The entire reset period t4 may be omitted according to the driving method of the display device 10.

If one electrode of the storage capacitor Cst is always applied with the first power source voltage ELVDD, the voltage Vdat−Vth transmitted to the gate electrode of the driving transistor M2 may not be sufficiently stored to the sustain capacitor Cst during the threshold voltage compensation and data writing period t2 by the voltage drop in the power source wire of the first power source voltage ELVDD. Accordingly, the driving current Ioled flowing to the organic light emitting diode (OLED) during the light emitting period t3 may not be uniform, such that the luminance deviation may be generated.

As discussed above, the reference voltage Vsus applied through the separate wire that is different from the power source wire of the first power source voltage ELVDD is applied to one electrode of the sustain capacitor Cst during the threshold voltage compensation and data writing period t2 such that the sustain capacitor Cst may sufficiently store the voltage Vdat−Vth. Accordingly, the driving current Ioled flowing to the organic light emitting diode (OLED) during the light emitting period t3 may be uniform and the luminance deviation of the display device 10 due to the voltage drop by the power source wire may be reduced or eliminated.

Next, for driving the display device 10, a light emission driver 500 sequentially outputting a plurality of light emitting signals Em[1]-Em[n] and a plurality of reverse light emitting signals EmB[1]-EmB[n] and simultaneously outputting a plurality of light emitting signals Em[1]-Em[n] and a plurality of reverse light emitting signals EmB[1]-EmB[n] during the entire reset period t4 will be described.

Figure 4:
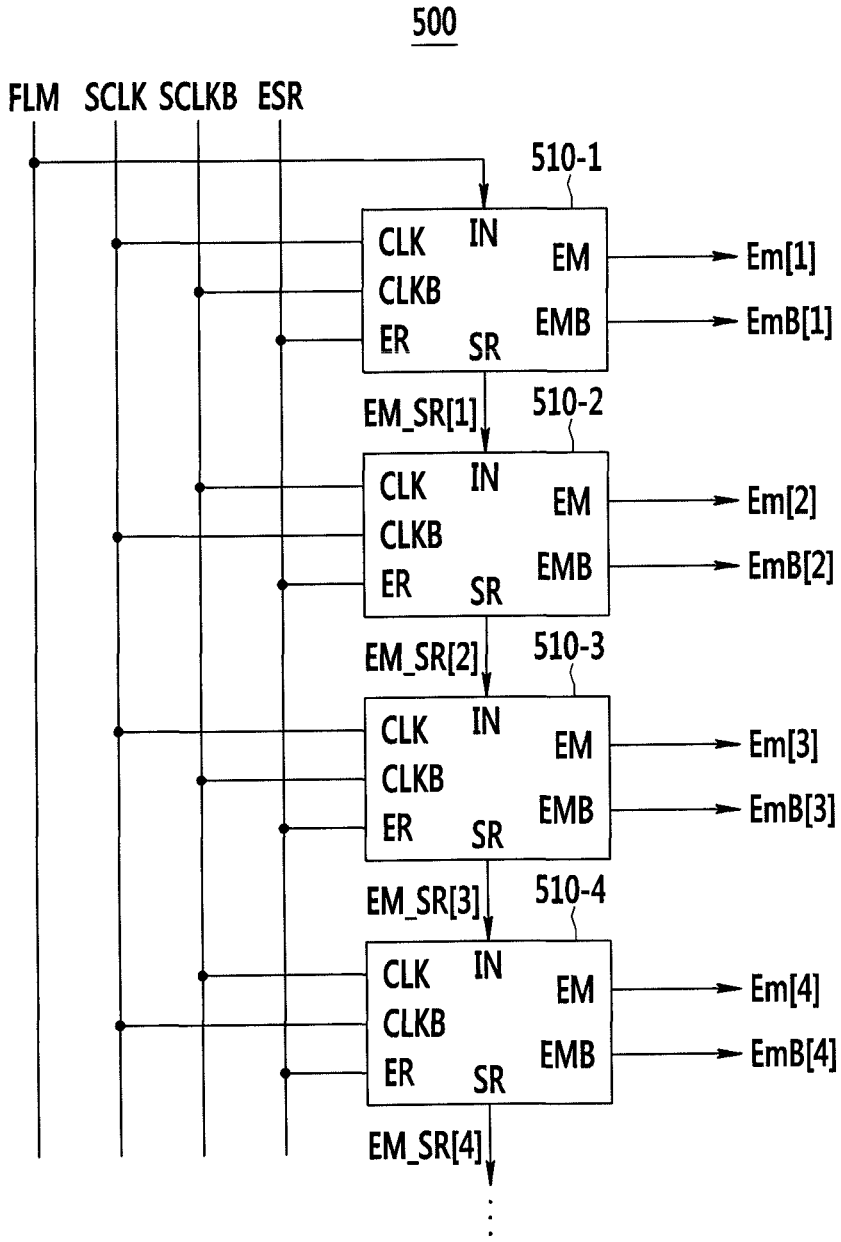
FIG. 4 is a block diagram of a light emission driver according to an example embodiment.

FIG. 4 is a block diagram of a light emission driver according to an example embodiment.

In the example embodiment shown in FIG. 4, the light emission driver 500 includes a plurality of light emitting driving blocks 510-1, 510-2, 510-3, 510-4, . . . generating a plurality of light emitting signals Em[1]-Em[n] and a plurality of reverse light emitting signals EmB[1]-EmB[n]. Each of the light emitting driving blocks 510-1, 510-2, 510-3, 510-4, . . . receives the input signal to generate the light emitting signals Em[1]-Em[n] respectively transmitted to a plurality of light emitting lines and the reverse light emitting signals EmB[1]-EmB[n] respectively transmitted to a plurality of reverse light emitting lines.

The input signal of each of the light emitting driving blocks 510-1, 510-2, 510-3, 510-4, . . . includes the first clock signal SCLK1, the second clock signal SCLKB, all reset signals ESR, and a frame start signal FLM or a relay signals EM_SR of the adjacent light emitting driving block.

Each of the light emitting driving blocks 510-1, 510-2, 510-3, 510-4, . . . includes the first clock signal input terminal CLK, the second clock signal input terminal CLKB, the entire reset signal input terminal ER, a sequential input terminal IN input with the frame start signal FLM or the relay signals EM_SR, the light emitting signal output terminal EM, the reverse light emitting signal output terminal EMB, and the relay signal output terminal SR.

The first clock signal input terminal CLK of the odd-numbered light emitting driving blocks 510-1, 510-3, . . . is coupled to a wire of the first clock signal SCLK, and the second clock signal input terminal CLKB is coupled to a wire of the second clock signal SCLKB. The first clock signal input terminal CLK of the even-numbered light emitting driving blocks 510-2, 510-4, . . . is coupled to a wire of the second clock signal SCLKB, and the second clock signal input terminal CLKB is coupled to a wire of the first clock signal SCLK.

The sequential input terminal IN of the first light emitting driving block 510-1 is applied with the frame start signal FLM, and the sequential input terminal IN of the rest of the light emitting driving blocks 510-2, 510-3, 510-4, . . . is input with the relay signals EM_SR[1], EM_SR[2], EM_SR[3], . . . of the scan driving blocks that are previously arranged.

Each of the light emitting driving blocks 510-1, 510-2, 510-3, 510-4, . . . output the light emitting signals Em[1], Em[2], Em[3], Em[4], . . . , the reverse light emitting signals EmB[1], EmB[2], EmB[3], EmB[4], . . . , and the relay signals EM_SR[1], EM_SR[2], EM_SR[3], EM_SR[4], . . . that are generated according to the signal input to the sequential input terminal IN, the first clock signal input terminal CLK, the second clock signal input terminal CLKB, and the entire reset signal input terminal ER.

As the frame start signal FLM of the gate-on voltage is applied to the sequential input terminal IN, the first light emitting driving block 510-1 outputs the light emitting signals Em[1] to the first light emitting line and the reverse light emitting signals EmB[1] to the first reverse light emitting line, and the relay signals EM_SR[1] to the second light emitting driving block 510-2. As the relay signals EM_SR[1] of the gate-on voltage are applied to the sequential input terminal IN from the first light emitting driving block 510-1, the second light emitting driving block 510-2 outputs the light emitting signals Em[2] to the second light emitting line, the reverse light emitting signals EmB[2] to the second reverse light emitting line, and the relay signals EM_SR[2] to the third light emitting driving block 510-3. As described above, a plurality of light emitting driving blocks 510-1, 510-2, 510-3, 510-4, . . . sequentially output the light emitting signals Em[1], Em[2], Em[3], Em[4], . . . , the reverse light emitting signals EmB[1], EmB[2], EmB[3], EmB[4], . . . , and the relay signals EM_SR[1], EM_SR[2], EM_SR[3], EM_SR[4], . . . .

Figure 5:
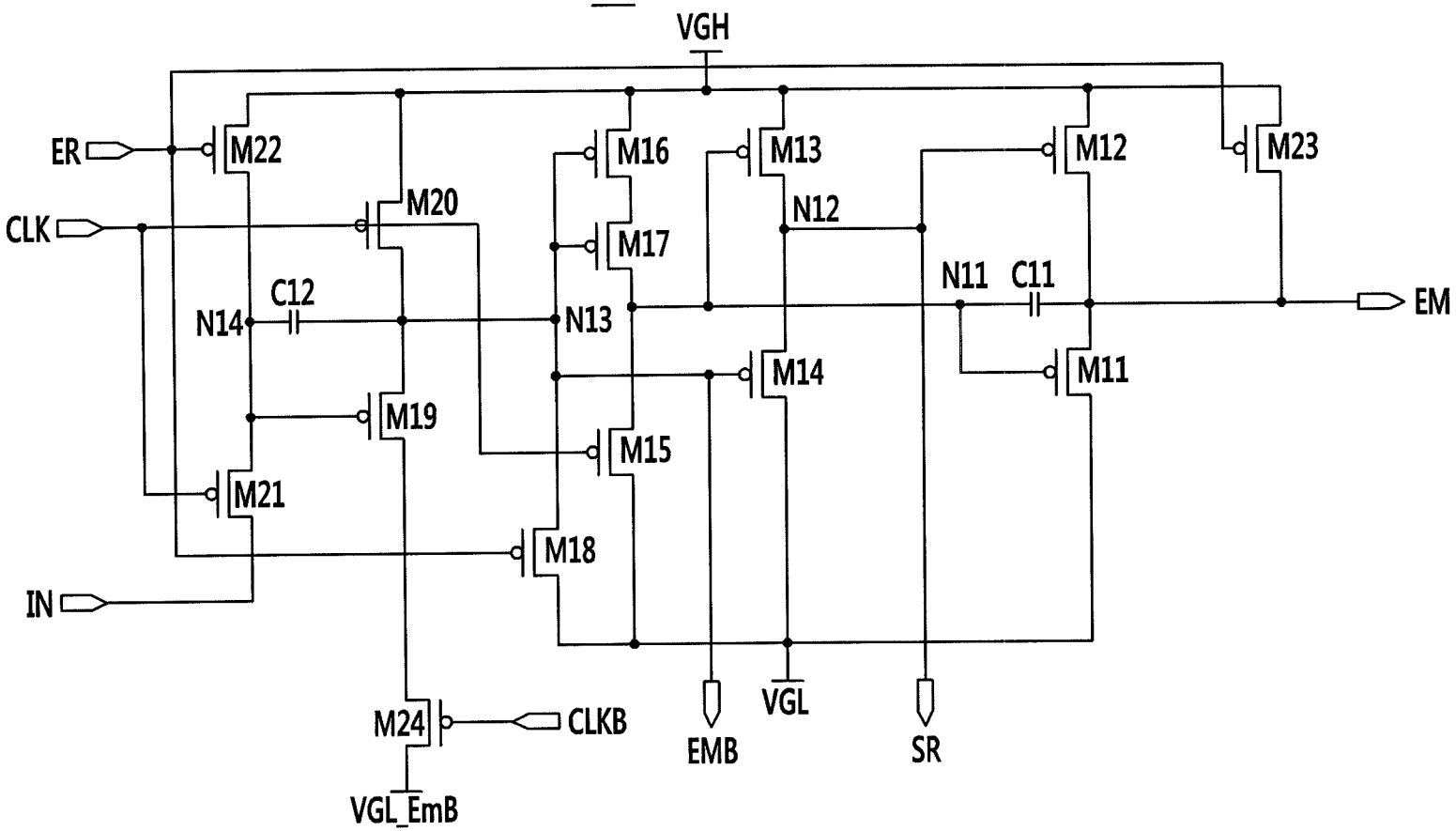
FIG. 5 is a circuit diagram of a light emitting driving block included in a light emission driver according to an example embodiment.

FIG. 5 is a circuit diagram of a light emitting driving block included in a light emission driver according to an example embodiment.

In the example embodiment shown in FIG. 5, the light emitting driving block 510 includes a plurality of transistors M11 to M24 and a plurality of capacitors C11 and C12.

The first transistor M11 includes the gate electrode coupled to the first node N11, one electrode coupled to the second light emitting power source voltage VGL, and the other electrode coupled to the light emitting signal output terminal EM.

The second transistor M12 includes the gate electrode coupled to the second node N12, one electrode coupled to the first light emitting power source voltage VGH, and the other electrode coupled to the light emitting signal output terminal EM.

The third transistor M13 includes the gate electrode coupled to the first node N11, one electrode coupled to the first light emitting power source voltage VGH, and the other electrode coupled to the second node N12.

The fourth transistor M14 includes the gate electrode coupled to the third node N13, one electrode coupled to the second light emitting power source voltage VGL, and the other electrode coupled to the second node N12.

The fifth transistor M15 includes the gate electrode coupled to the first clock signal input terminal CLK, one electrode coupled to the second light emitting power source voltage VGL, and the other electrode coupled to the first node N11.

The sixth transistor M16 includes the gate electrode coupled to the third node N13, one electrode coupled to the first light emitting power source voltage VGH, and the other electrode coupled to one electrode of the seventh transistor M17.

The seventh transistor M17 includes the gate electrode coupled to the third node N13, one electrode coupled to the other electrode of the sixth transistor M16, and the other electrode coupled to the first node N11.

The eighth transistor M18 includes the gate electrode coupled to the entire reset signal input terminal ER, one electrode coupled to the second light emitting power source voltage VGL, and the other electrode coupled to the third node N13.

The ninth transistor M19 includes the gate electrode coupled to the fourth node N14, one electrode coupled to the other electrode of the fourteenth transistor M24, and the other electrode coupled to the third node N13.

The tenth transistor M20 includes the gate electrode coupled to the first clock signal input terminal CLK, one electrode coupled to the first light emitting power source voltage VGH, and the other electrode coupled to the third node N13.

The eleventh transistor M21 includes the gate electrode coupled to the first clock signal input terminal CLK, one electrode coupled to the sequential input terminal IN, and the other electrode coupled to the fourth node N14.

The twelfth transistor M22 includes the gate electrode coupled to the entire reset signal input terminal ER, one electrode coupled to the first light emitting power source voltage VGH, and the other electrode coupled to the fourth node N14.

The thirteenth transistor M23 includes the gate electrode coupled to the entire reset signal input terminal ER, one electrode coupled to the first light emitting power source voltage VGH, and the other electrode coupled to the light emitting signal output terminal EM.

The fourteenth transistor M24 includes the gate electrode coupled to the second clock signal input terminal CLKB, one electrode coupled to the third light emitting power source voltage VGL_EmB, and the other electrode coupled to one electrode of the ninth transistor M19.

The first capacitor C11 includes one electrode coupled to the first node N11 and the other electrode coupled to the light emitting signal output terminal EM.

The second capacitor C12 includes one electrode coupled to the fourth node N14 and the other electrode coupled to the third node N13.

The relay signal output terminal SR is coupled to the second node N12, and the reverse light emitting signal output terminal EMB is coupled to the third node N13.

The plurality of transistors M11 to M24 may be p-channel field effect transistors. At this time, the gate-on voltage turning on the plurality of transistors M11 to M24 is the low level voltage and the gate-off voltage turning them off is the high level voltage.

Here, the p-channel field effect transistor is described, but one or more of the plurality of transistors M11 to M24 may be the n-channel field effect transistor. At this time, the gate-on voltage turning on the n-channel field effect transistor is the high level voltage and the gate-off voltage turning it off is the low level voltage.

The plurality of transistors M11 to M24 may be formed of, e.g., the amorphous silicon thin film transistor (amorphous-Si TFT), the low temperature polysilicon (LTPS) thin film transistor, the oxide thin film transistor (oxide TFT), etc.

Next, a driving method of the light emission driver 500 will be described with reference to FIGS. 4 to 6.

Figure 6:
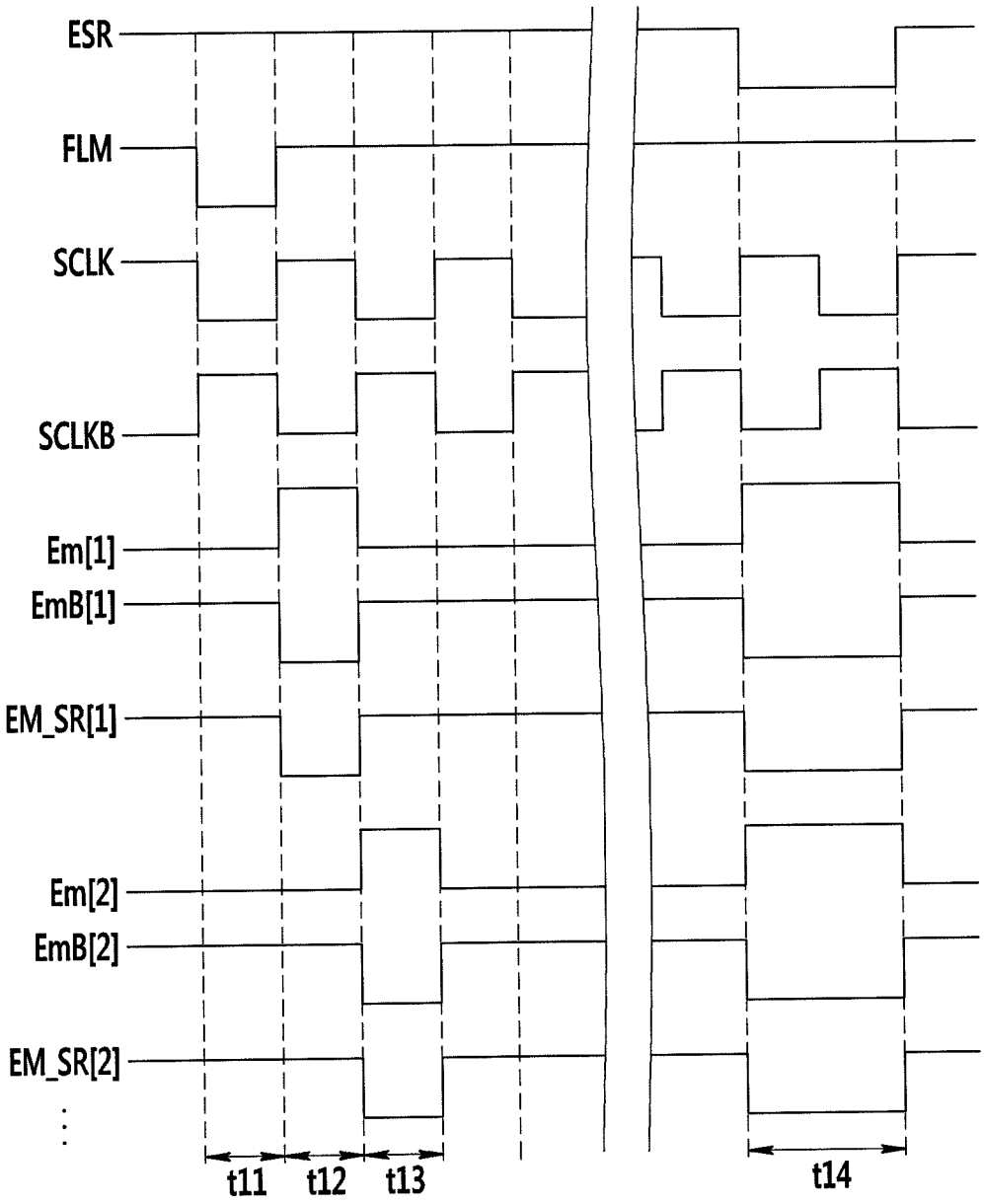
FIG. 6 is a timing diagram of a driving method of a light emission driver according to an example embodiment.

FIG. 6 is a timing diagram of a driving method of a light emission driver according to an example embodiment.

Referring to FIGS. 4 to 6, the first clock signal SCLK and the second clock signal SCLKB are periodically repeated and applied as the gate-on voltage and the gate-off voltage. At this time, the second clock signal SCLKB is a reverse signal to the first clock signal SCLK. That is, the second clock signal SCLKB periodically repeated and applied with the level reverse to the level of the first clock signal SCLK.

All reset signals ESR are applied as the low level voltage during the time t4 that a plurality of light emitting signals Em[1]-Em[n] and a plurality of reverse light emitting signals EmB[1]-EmB[n] are simultaneously output, and are applied as the high level voltage during the rest of the time. The frame start signal FLM is applied as the low level voltage during the time t11 of one frame and is applied as the high level voltage during the rest of the time.

Firstly, the operation of the first light emitting driving block 510-1 will be described.

During the time t11, the frame start signal FLM is applied as the low level voltage, the first clock signal SCLK is applied as the low level voltage, and the second clock signal SCLKB is applied as the high level voltage. The frame start signal FLM is input to the sequential input terminal IN of the first light emitting driving block 510-1. The first clock signal SCLK is input to the clock signal input terminal CLK of the first light emitting driving block 510-1. The fifth transistor M15, the tenth transistor M20, and the eleventh transistor M21 are turned on by the first clock signal SCLK. The frame start signal FLM of the low level voltage applied to the sequential input terminal IN is transmitted to the fourth node N14 through the turned-on eleventh transistor M21. The voltage of the fourth node N14 becomes the low level voltage, and the ninth transistor M19 is turned on. The first light emitting power source voltage VGH is transmitted to the third node N13 through the turned-on tenth transistor M20. The voltage of the third node N13 becomes the high level voltage, and the reverse light emitting signals EmB[1] of the high level voltage is output to the reverse light emitting signal output terminal EMB. The voltage corresponding to the difference between the voltage of the fourth node N14 and the voltage of the third node N13 is stored to the second capacitor C12. The fourth transistor M14, the sixth transistor M16, and the seventh transistor M17 are turned off by the voltage of the third node N13. The second light emitting power source voltage VGL is transmitted to the first node N11 through the turned-on fifth transistor M15. The voltage of the first node N11 becomes the low level voltage, and the first transistor M11 and the third transistor M13 are turned on by the voltage of the first node N11. The second light emitting power source voltage VGL is transmitted to the light emitting signal output terminal EM through the turned-on first transistor M11. The light emitting signal Em[1] of the low level voltage is output to the light emitting signal output terminal EM. The first light emitting power source voltage VGH is transmitted to the second node N12 through the turned-on third transistor M13, and the voltage of the second node N12 becomes the high level voltage. The second transistor M12 is turned-off by the voltage of the second node N12, and the relay signals EM_SR [1] of the high level voltage are output to the relay signal output terminal SR.

During a time t12, the first clock signal SCLK is applied as the high level voltage and the second clock signal SCLKB is applied as the low level voltage. The fifth transistor M15, the tenth transistor M20, and the eleventh transistor M21 are turned off by the first clock signal SCLK. At this time, the voltage of the fourth node N14 is maintained as the low level voltage by the voltage of the second capacitor C12, and the ninth transistor M19 is in the turned-on state. The fourteenth transistor M24 is turned on by the second clock signal SCLKB. The third light emitting power source voltage VGL_EmB is transmitted to the third node N13 through the turned-on fourteenth transistor M24 and ninth transistor M19. The voltage of the third node N13 becomes the low level voltage. The fourth transistor M14, the sixth transistor M16, and the seventh transistor M17 are turned on by the voltage of the third node N13. Also, by the voltage of the third node N13, the reverse light emitting signals EmB[1] of the low level voltage are output to the reverse light emitting signal output terminal EMB. The first light emitting power source voltage VGH is transmitted to the first node N11 by the turned-on sixth transistor M16 and seventh transistor M17. The voltage of the first node N11 becomes the high level voltage. The first transistor M11 and the third transistor M13 are turned off by the voltage of the first node N11. The second light emitting power source voltage VGL is transmitted to the second node N12 through the turned-on fourth transistor M14. The voltage of the second node N12 becomes the low level voltage. The second transistor M12 is turned on by the voltage of the second node N12, and the relay signals EM_SR[1] of the low level voltage are output to the relay signal output terminal SR. The first light emitting power source voltage VGH is transmitted to the light emitting signal output terminal EM through the turned-on second transistor M12. The light emitting signals Em[1] of the high level voltage is output to the light emitting signal output terminal EM.

During a time t13, the first clock signal SCLK is applied as the low level voltage and the second clock signal SCLKB is applied as the high level voltage. The fifth transistor M15, the tenth transistor M20, and the eleventh transistor M21 are turned on by the first clock signal SCLK. The frame start signal FLM of the high level voltage applied to the sequential input terminal IN is transmitted to the fourth node N14 through the turned-on eleventh transistor M21. The voltage of the fourth node N14 becomes the high level voltage. The ninth transistor M19 is turned off by the voltage of the fourth node N14. The first light emitting power source voltage VGH is transmitted to the third node N13 through the turned-on tenth transistor M20. The voltage of the third node N13 becomes the high level voltage. The fourth transistor M14, the sixth transistor M16, and the seventh transistor M17 are turned off by the voltage of the third node N13. Also, the reverse light emitting signal EmB[1] of the high level voltage is output to the reverse light emitting signal output terminal EMB by the voltage of the third node N13. The second light emitting power source voltage VGL is transmitted to the first node N11 through the turned-on fifth transistor M15. The voltage of the first node N11 becomes the low level voltage. The first transistor M11 and the third transistor M13 are turned on by the voltage of the first node N11. The second light emitting power source voltage VGL is transmitted to the light emitting signal output terminal EM through the turned-on first transistor M11. The light emitting signal Em[1] of the low level voltage is output to the light emitting signal output terminal EM. The first light emitting power source voltage VGH is transmitted to the second node N12 through the turned-on third transistor M13. The voltage of the second node N12 becomes the high level voltage. The second transistor M12 is turned-off by the voltage of the second node N12 and the relay signal EM_SR [1] of the high level voltage is output to the relay signal output terminal SR.

For the second light emitting driving block 510-2, the relay signal EM_SR[1] of the first light emitting driving block 510-1 is applied to the sequential input terminal IN, the second clock signal SCLKB is applied to the first clock signal input terminal CLK, and the first clock signal SCLK is applied to the second clock signal input terminal CLKB. Accordingly, the second light emitting driving block 510-2 outputs the light emitting signal Em[2] of the high level voltage during the time t3 that is delayed by a duty of the clock signal SCLK and SCLKB rather than the time t2 in which the first light emitting driving block 510-1 outputs the light emitting signal Em[1] of the high level voltage. Also, the second light emitting driving block 510-2 outputs the reverse light emitting signal EmB[2] of the low level voltage and the relay signal EM_SR[2] during the time t13. Thus, the second light emitting driving block 510-2 is delayed relative to the first light emitting driving block 510-1 by the duty of the clock signals SCLK and SCLKB.

By this method, a plurality of light emitting driving blocks 510-1, 510-2, 510-3, 510-4, . . . sequentially output the light emitting signals Em[1], Em[2], Em[3], Em[4], . . . , the reverse light emitting signals EmB[1], EmB[2], EmB[3], EmB[4], . . . , and the relay signals EM_SR[1], EM_SR[2], EM_SR[3], EM_SR[4], . . . .

During a time t14, all reset signals ESR are applied as the low level voltage. All reset signals ESR are simultaneously applied to a plurality of light emitting driving blocks 510-1, 510-2, 510-3, 510-4, . . . and each entire reset signal input terminal ER. If all reset signals ESR are applied as the low level voltage, the eighth transistor M18, the twelfth transistor M22, and the thirteenth transistor M23 are turned on. As the twelfth transistor M22 is turned on, the first light emitting power source voltage VGH is transmitted to the fourth node N14. The voltage of the fourth node N14 becomes the high level voltage. The ninth transistor M19 is turned off by the voltage of the fourth node N14. As the eighth transistor M18 is turned on, the second light emitting power source voltage VGL is transmitted to the third node N13. The voltage of the third node N13 becomes the low level voltage. The reverse light emitting signals EmB[1], EmB[2], EmB[3], EmB[4], . . . of the low level voltage are output to the reverse light emitting signal output terminal EMB by the voltage of the third node N13. Also, the fourth transistor M14, the sixth transistor M16, and the seventh transistor M17 are turned on by the voltage of the third node N13. As the sixth transistor M16 and the seventh transistor M17 are turned on, the first light emitting power source voltage VGH is transmitted to the first node N11. The voltage of the first node N11 becomes the high level voltage. The first transistor M11 and the third transistor M13 are turned off by the voltage of the first node N11. As the fourth transistor M14 is turned on, the second light emitting power source voltage VGL is transmitted to the second node N12. The voltage of the second node N12 becomes the low level voltage. The relay signals EM_SR[1], EM_SR[2], EM_SR[3], EM_SR[4], . . . of the low level voltage are output to the relay signal output terminal SR by the voltage of the second node N12. The second transistor M12 is turned on by the voltage of the second node N12. The first light emitting power source voltage VGH is transmitted to the light emitting signal output terminal EM through the turned-on second transistor and thirteenth transistor M23. The light emitting signals Em[1], Em[2], Em[3], Em[4], . . . of the high level voltage are output to the light emitting signal output terminal EM.

All reset signals ESR simultaneously apply a plurality of the light emitting driving blocks 510-1, 510-2, 510-3, 510-4, . . . so, during the time t14 in which all reset signals ESR are applied as the low level voltage, a plurality of light emitting driving blocks 510-1, 510-2, 510-3, 510-4, . . . simultaneously output the light emitting signals Em[1], Em[2], Em[3], Em[4], . . . of the high level voltage and the reverse light emitting signals EmB[1], EmB[2], EmB[3], EmB[4], . . . of the low level voltage. The time t14 corresponds to the entire reset period t4 described in FIG. 3.

As described above, the third light emitting power source voltage VGL_EmB, separate from the second light emitting power source voltage VGL, is provided in the light emitting driving block 510 such that the reverse light emitting signals EmB[i] of the low level voltage are stably output. As the reverse light emitting signals EmB[i] of the low level voltage are stably output, the initialization period t1 and the threshold voltage compensation and data writing period t2 described in FIG. 3 may be further performed. Accordingly, the effect of preventing the luminance deviation of the display device 10 by the voltage drop due to the power source wire may be further improved by using the pixel 510.

By way of summation and review, image quality may be deteriorated by a voltage drop (IR-drop) in a power source wire transmitting a power source voltage to a pixel. In such a situation, a relatively low voltage (i.e., lower than the voltage that is actually applied) is transmitted to the pixel as a result of the voltage drop in the power source wire, such that a current amount flowing to the driving transistor is influenced, thereby generating a luminance deviation of the display device.

As described above, embodiments relate to a display device configured to reduce an influence of a voltage drop by a power source wire, and a light emitting driving apparatus for a display device. Embodiments may provide a display device in which a deterioration of image quality due to a voltage drop by a power source wire is reduced or eliminated, and a light emitting driving apparatus for the display device.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

Description of Symbols

10: display device
100: signal controller
200: scan driver
300: data driver
400: power source driver
500: light emission driver
600: display unit

What is claimed is:

1. A light emitting driving apparatus for a display device, the apparatus comprising:

a plurality of light emitting driving blocks, wherein the plurality of light emitting driving blocks respectively include:

a first node applied with a second light emitting power source voltage according to a clock signal input to a first clock signal input terminal and applied with a first light emitting power source voltage according to a clock signal input to a second clock signal input terminal, a second node applied with the first light emitting power source voltage according to the clock signal input to the first clock signal input terminal, the second node being coupled to a relay signal output terminal outputting a relay signal, a third node applied with the first light emitting power source voltage according to the clock signal input to the first clock signal input terminal, and applied with a third light emitting power source voltage according to a clock signal input to the second clock signal input terminal, the third node being coupled to a reverse light emitting signal output terminal outputting a reverse light emitting signal, a first transistor turned on by a voltage of the first node to transmit the second light emitting power source voltage to a light emitting signal output terminal outputting a light emitting signal, and a second transistor turned on by a voltage of the second node to transmit the first light emitting power source voltage to the light emitting signal output terminal.

2. The apparatus as claimed in claim 1, wherein the plurality of light emitting driving blocks further respectively include a third transistor having a gate electrode coupled to the first node, a first electrode coupled to the first light emitting power source voltage, and a second electrode coupled to the second node.

3. The apparatus as claimed in claim 2, wherein the plurality of light emitting driving blocks further respectively include a fourth transistor having a gate electrode coupled to the third node, a first electrode coupled to the second light emitting power source voltage, and a second electrode coupled to the second node.

4. The apparatus as claimed in claim 3, wherein the plurality of light emitting driving blocks further respectively include a fifth transistor having a gate electrode coupled to the first clock signal input terminal, a first electrode coupled to the second light emitting power source voltage, and a second electrode coupled to the first node.

5. The apparatus as claimed in claim 4, wherein the plurality of light emitting driving blocks respectively include:

a sixth transistor having a gate electrode coupled to the third node and a first electrode coupled to the first light emitting power source voltage, and a seventh transistor having a gate electrode coupled to the third node, a first electrode coupled to a second electrode of the sixth transistor, and a second electrode coupled to the first node.

6. The apparatus as claimed in claim 5, wherein the plurality of light emitting driving blocks further respectively include:

a fourth node applied with a relay signal input to a sequential input terminal according to the clock signal input to the first clock signal input terminal, and a ninth transistor having a gate electrode coupled to the fourth node, a first electrode applied with a third light emitting power source voltage according to the clock signal input to the second clock signal input terminal, and a second electrode coupled to the third node.

7. The apparatus as claimed in claim 6, wherein the plurality of light emitting driving blocks further respectively include a fourteenth transistor having a gate electrode coupled to the second clock signal input terminal, a first electrode coupled to the third light emitting power source voltage, and a second electrode coupled to a first electrode of the ninth transistor.

8. The apparatus as claimed in claim 7, wherein the plurality of light emitting driving blocks further respectively include a tenth transistor having a gate electrode coupled to the first clock signal input terminal, a first electrode coupled to the first light emitting power source voltage, and a second electrode coupled to the third node.

9. The apparatus as claimed in claim 8, wherein the plurality of light emitting driving blocks further respectively include an eleventh transistor having a gate electrode coupled to the first clock signal input terminal, a first electrode coupled to the sequential input terminal, and a second electrode coupled to the fourth node.

10. The apparatus as claimed in claim 9, wherein:

the plurality of light emitting driving blocks respectively include an entire reset signal input terminal, and a plurality of light emitting driving blocks simultaneously output the first light emitting power source voltage to the light emitting signal output terminal and simultaneously output the second light emitting power source voltage to the relay signal output terminal, and simultaneously output the third light emitting power source voltage to the reverse light emitting signal output terminal according to an entire reset signal input to the entire reset signal input terminal.

11. The apparatus as claimed in claim 10, wherein the plurality of light emitting driving blocks further respectively include an eighth transistor having a gate electrode coupled to the entire reset signal input terminal, a first electrode coupled to the second light emitting power source voltage, and a second electrode coupled to the third node.

12. The apparatus as claimed in claim 11, wherein the plurality of light emitting driving blocks further respectively include a twelfth transistor having a gate electrode coupled to the entire reset signal input terminal, a first electrode coupled to the first light emitting power source voltage, and a second electrode coupled to the fourth node.

13. The apparatus as claimed in claim 12, wherein the plurality of light emitting driving blocks further respectively include a thirteenth transistor having a gate electrode coupled to the entire reset signal input terminal, a first electrode coupled to the first light emitting power source voltage, and a second electrode coupled to the light emitting signal output terminal.

14. The apparatus as claimed in claim 13, wherein at least one of the first to fourteenth transistors is an oxide thin film transistor.

15. A display device, comprising:

a plurality of pixels including a driving transistor controlling a driving current flowing to an organic light emitting diode (OLED) and a sustain capacitor including a first electrode coupled to a gate electrode of the driving transistor; and a light emission driver outputting a reverse light emitting signal of a gate-on voltage to apply a reference voltage to a second electrode of the sustain capacitor during a period in which a data voltage is respectively applied to a plurality of pixels, and outputting a light emitting signal of the gate-on voltage to apply a first power source voltage to the second electrode of the sustain capacitor during a period in which the OLED emits light by the driving current, wherein the light emission driver includes a plurality of light emitting driving blocks, and the plurality of light emitting driving blocks respectively include:

a first node applied with a second light emitting power source voltage according to a clock signal input to a first clock signal input terminal, and applied with a first light emitting power source voltage according to a clock signal input to a second clock signal input terminal, a second node applied with the first light emitting power source voltage according to the clock signal input to the first clock signal input terminal, the second node being coupled to a relay signal output terminal outputting a relay signal, a third node applied with the first light emitting power source voltage according to the clock signal input to the first clock signal input terminal, and applied with a third light emitting power source voltage according to a clock signal input to the second clock signal input terminal, the third node being coupled to a reverse light emitting signal output terminal outputting a reverse light emitting signal, a first transistor turned on by a voltage of the first node to transmit the second light emitting power source voltage to a light emitting signal output terminal outputting the light emitting signal, and a second transistor turned on by a voltage of the second node to transmit the first light emitting power source voltage to the light emitting signal output terminal.

16. The display device as claimed in claim 15, wherein the driving transistor includes the gate electrode coupled to first electrode of the sustain capacitor, a first electrode applied with the first power source voltage according to the light emitting signal, and a second electrode coupled to the OLED according to the light emitting signal.

17. The display device as claimed in claim 16, wherein the plurality of pixels further respectively include:

a switching transistor turned on by a scan signal of a gate-on voltage to transmit the data voltage to the first electrode of the driving transistor, and a compensation transistor turned on by the scan signal of the gate-on voltage to diode-connect the driving transistor.

18. The display device as claimed in claim 17, wherein the plurality of pixels further respectively include an initialization transistor that is turned on by an earlier scan signal, which is applied before the scan signal of the gate-on voltage is applied, to transmit an initialization voltage to the gate electrode of the driving transistor.

19. The display device as claimed in claim 18, wherein the plurality of pixels further respectively include:

a first light emitting transistor having a gate electrode applied with the light emitting signal, a first electrode coupled to the first power source voltage, and a second electrode coupled to the first electrode of the driving transistor, and a second light emitting transistor having a gate electrode applied with the light emitting signal, a first electrode coupled to the second electrode of the driving transistor, and a second electrode coupled to the OLED.

20. The display device as claimed in claim 19, wherein the plurality of pixels further respectively include:

a first reference voltage transistor having a gate electrode applied with the reverse light emitting signal, a first electrode coupled to the reference voltage, and a second electrode coupled to the second electrode of the sustain capacitor, and a second reference voltage transistor having a gate electrode applied with the light emitting signal, a first electrode coupled to the first power source voltage, and a second electrode coupled to the second electrode of the sustain capacitor.

21. The display device as claimed in claim 20, wherein at least one of the switching transistor, the driving transistor, the compensation transistor, the initialization transistor, the first light emitting transistor, the second light emitting transistor, the first reference voltage transistor, and the second reference voltage transistor is an oxide thin film transistor.

* * * * *